US006609708B2

(12) United States Patent
Moore et al.

(10) Patent No.: US 6,609,708 B2
(45) Date of Patent: Aug. 26, 2003

(54) VACUUM CORRUGATION SHUTTLE FEED DEVICE FOR HIGH CAPACITY FEEDER

(75) Inventors: Kenneth P. Moore, Rochester, NY (US); William R. Haag, Rochester, NY (US); Michael J. Linder, Walworth, NY (US); Stephen B. Williams, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/106,928

(22) Filed: Mar. 26, 2002

(65) Prior Publication Data

US 2002/0140157 A1 Oct. 3, 2002

Related U.S. Application Data

(62) Division of application No. 09/220,973, filed on Dec. 23, 1998.

(51) Int. Cl.[7] ..... B65H 3/14
(52) U.S. Cl. ..... 271/98; 271/107
(58) Field of Search ..... 271/97, 98, 107, 271/111, 112

(56) References Cited

U.S. PATENT DOCUMENTS

| | | | |
|---|---|---|---|
| 2,243,170 | A | 5/1941 | Seybold et al. |
| 3,716,226 | A | 2/1973 | Kistner |
| 3,836,139 | A | 9/1974 | Shimizu |
| 3,938,800 | A | 2/1976 | Wirz |
| 4,129,294 | A | 12/1978 | Marass |
| 4,470,589 | A | 9/1984 | Singer |
| 4,575,298 | A | 3/1986 | Maas et al. |
| 4,589,645 | A | 5/1986 | Tracy |

(List continued on next page.)

FOREIGN PATENT DOCUMENTS

| | | |
|---|---|---|
| EP | 0677467 | 10/1995 |
| EP | 0734984 | 10/1996 |
| GB | 1 230 509 | 5/1971 |
| JP | 61-178351 A | 8/1986 |

OTHER PUBLICATIONS

Copy of EPO Search Report for EP 99 12 5216.
Copy of EPO Search Report for EP 99 125 215.6.

*Primary Examiner*—Donald P. Walsh
*Assistant Examiner*—Joseph C Rodriguez
(74) *Attorney, Agent, or Firm*—William Eipert

(57) ABSTRACT

A feed apparatus which combines a slider crank feed head drive system and cam actuated stack height sensing system to form a new combined shuttle feeder. The new feed head drive includes the replacement of a solenoid driven feed head with a more reliable stepper driven twin slider crank drive. Included in the slider crank drive for the feed head is an integral cam as part of the crank arm mounted to the motor shaft. This cam is designed drives a stack height sensor to drop and lift the stack height sensing arm to sense stack height after the sheet trail edge has passed the point of arm contact with the stack. The cam also provides a "service mode" position for the stack height arm which lifts it out of the way of the paper supply when it is opening. The cam dwells in a neutral home position during the rest of the drive out and return motion of the feed head.

27 Claims, 11 Drawing Sheets

U.S. PATENT DOCUMENTS 4,610,444 A 9/1986 Land et al.
4,620,807 A 11/1986 Polit
4,632,377 A * 12/1986 Browse ..... 271/9.08
4,814,825 A 3/1989 Johdai et al.
4,882,988 A * 11/1989 Yamaguchi ..... 101/232
5,074,538 A 12/1991 Naumann
5,076,567 A 12/1991 Sasaki et al.
5,078,379 A 1/1992 Leisner
5,078,384 A 1/1992 Moore
5,083,763 A 1/1992 Hartta
5,090,676 A 2/1992 Matsuno et al.
5,090,683 A 2/1992 Kamath et al.
5,098,077 A 3/1992 Russel
5,274,242 A 12/1993 Dragon et al.
5,288,062 A * 2/1994 Rizzolo et al. ..... 270/58.12
5,310,170 A 5/1994 Yushita et al.
5,415,387 A 5/1995 Suzuki
5,462,265 A * 10/1995 Mandel et al. ..... 270/58.02
5,482,265 A 1/1996 Nakazato et al.
5,518,230 A 5/1996 Scarlata et al.
5,600,426 A 2/1997 Gramlich et al.
5,609,333 A * 3/1997 Mandel et al. ..... 270/58.09
5,622,364 A 4/1997 Dutton et al.
5,690,324 A 11/1997 Otomo et al.
5,692,742 A 12/1997 Tranquilla
5,707,056 A 1/1998 Rauen et al.
5,772,200 A 6/1998 Sorensen
5,775,683 A 7/1998 Rodi
5,794,176 A 8/1998 Milillo
5,823,527 A 10/1998 Burlew et al.
5,842,694 A * 12/1998 Brooks et al. ..... 271/110
5,884,135 A 3/1999 Moore
5,921,540 A 7/1999 Acquaviva et al.
5,941,518 A 8/1999 Sokac et al.
H1805 H 10/1999 Rider et al.
5,967,506 A 10/1999 Miki et al.
6,095,517 A 8/2000 Dinatale
6,247,695 B1 * 6/2001 Linder et al. ..... 271/153
6,279,895 B1 8/2001 Tranquilla
6,279,896 B1 * 8/2001 Linder et al. ..... 271/98
6,412,774 B1 * 7/2002 Saito et al. ..... 271/220

* cited by examiner

VACUUM CORRUGATION SHUTTLE FEED DEVICE FOR HIGH CAPACITY FEEDER

This application is a divisional of application Ser. No. 09/220,973, filed Dec. 23, 1998.

This invention relates generally to a high capacity, wide latitude of sheet characteristics feeder for an electrophotograph printing machine and, more particularly, concerns a vacuum corrugation shuttle feed head for the feeder.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color.

In single pass color machines and other high speed printers, it is desirable to feed a wide variety of media for printing thereon. A large latitude of sheet sizes and sheet weights, in addition to various coated stock and other specialty papers must be fed at high speed to the printer.

In accordance with one aspect of the present invention, there is provided a sheet feed apparatus comprising a vacuum source, said vacuum source being selectively actuable to acquire and release a top sheet from a stack, a feedhead, attached to said vacuum source to acquire the top sheet of the stack and a unidirectional drive mechanism, said drive mechanism being driven in a single direction while causing the feedhead to reciprocate from a first position to a second position.

In accordance with yet another aspect of the invention there is provided an electrophotographic printing machine having a sheet feed apparatus comprising a vacuum source, said vacuum source being selectively actuable to acquire and release a top sheet from a stack, a feedhead, attached to said vacuum source to acquire the top sheet of the stack; and a unidirectional drive mechanism, said drive mechanism being driven in a single direction while causing the feedhead to reciprocate from a first position to a second position.

Other features of the present invention will become apparent as the following description proceeds and upon reference to the drawings, in which.

This invention relates to an imaging system which is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
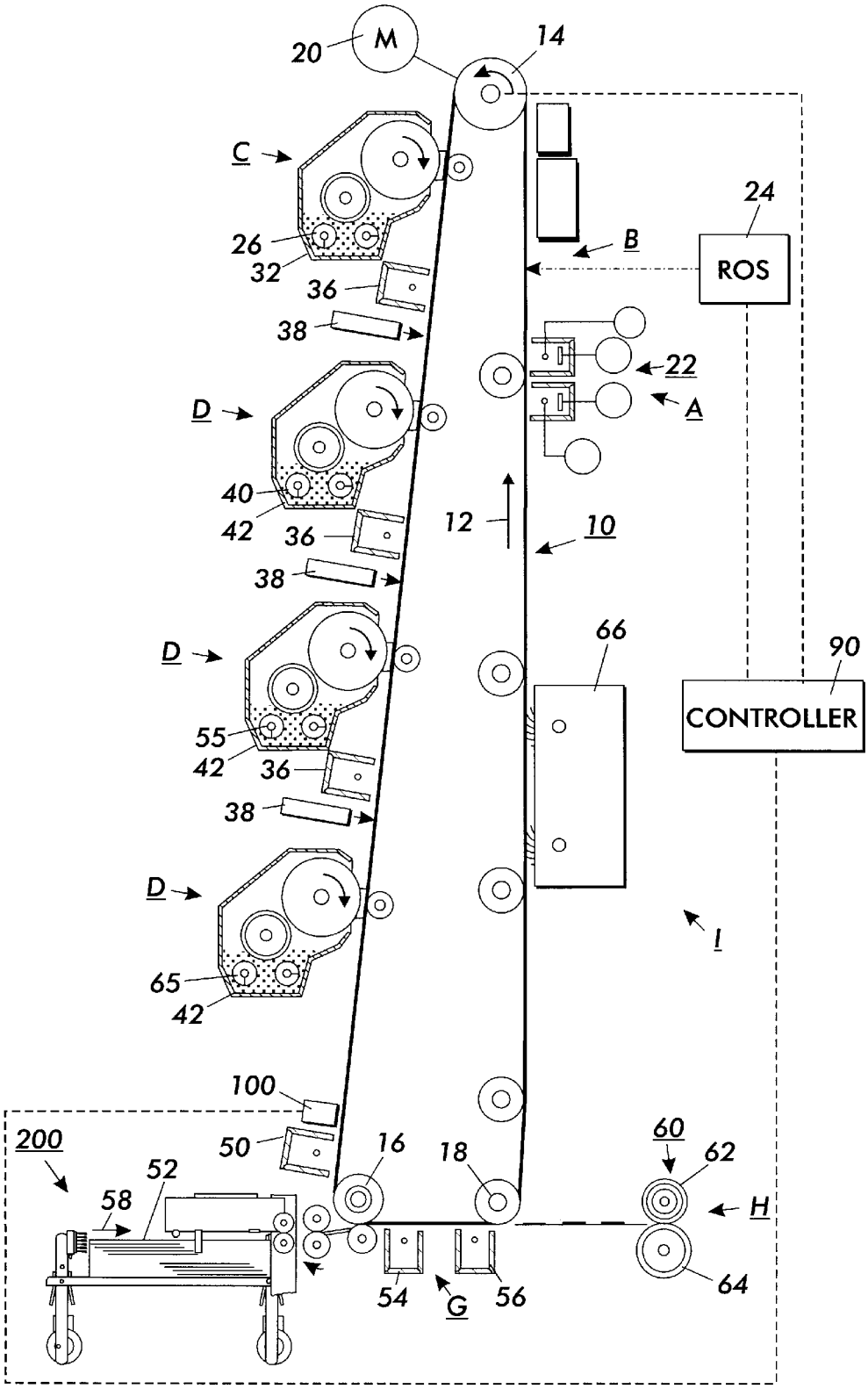
FIG. 1 is a schematic elevational view of a full color image-on-image single-pass electrophotographic printing machine utilizing the device described herein.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals from controller 100 representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 32 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by device 24 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by the sheet feeding apparatus of the present invention, described in detail below. The sheet of support material is then brought into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, stacker, finisher or other output device (not shown), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush or plural brush structure contained in a housing 66. The cleaning brush or brushes are engaged after the composite toner image is transferred to a sheet. Once the photoreceptor is cleaned the brushes may be retracted for the next imaging and development cycle.

It is believed that the foregoing description is sufficient for the purposes of the present application to illustrate the general operation of a color printing machine.

It is desirable in high speed color printers such as those described above to be able to feed a wide variety of sheet types for various printing jobs. Customers demand multiple sized stock, a wide range of paper weights, paper appearance characteristics ranging from rough flat appearing sheets to very high gloss coated paper stock. Each of these sheet types and size has its own unique characteristics and in many instances very different problems associated therewith to accomplish high speed feeding.

Figure 2:
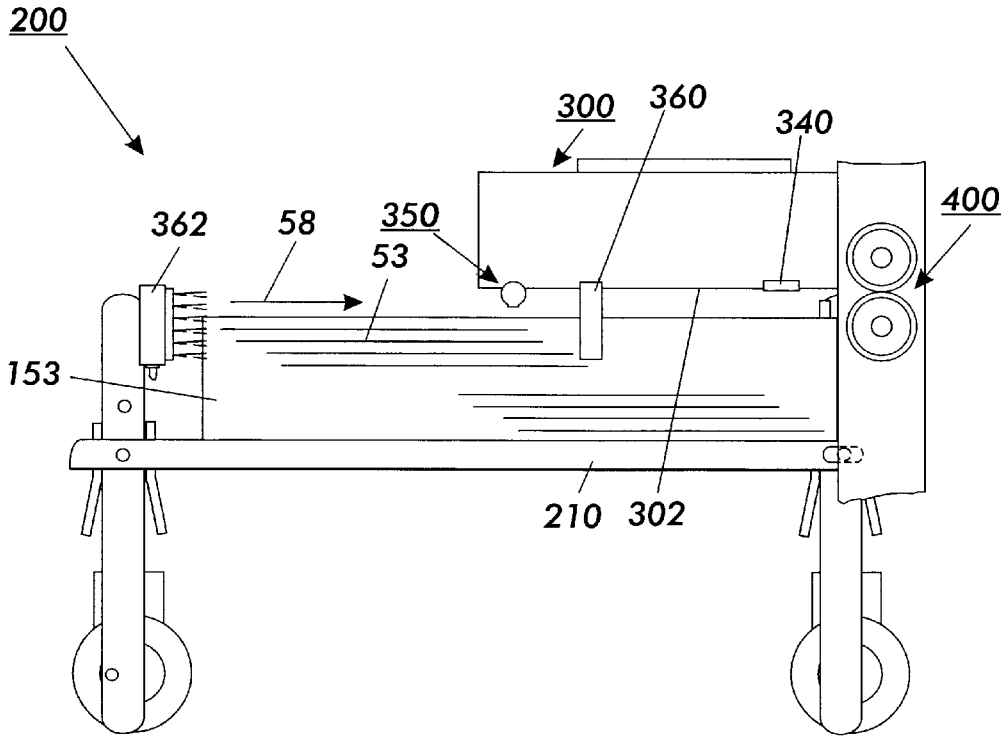
FIG. 2 is a side view illustrating the feeder apparatus including the invention herein.

There is shown in FIG. 2, a side elevational schematic view of the high ark speed, wide range of sheet characteristics feeder, generally indicated by reference numeral 200, incorporating the present invention. The basic components of the feeder 200 include a sheet support tray 210 which is tiltable and self adjusting to accommodate various sheet types and characteristics; multiple tray elevators 220, 230 and elevator drives 222, 232; a vacuum shuttle feedhead 300; a lead edge multiple range sheet height sensor 340; a multiple position stack height sensor 350; a variable acceleration take away roll (TAR) 400; and sheet fluffers 360, 362.

Figure 3:
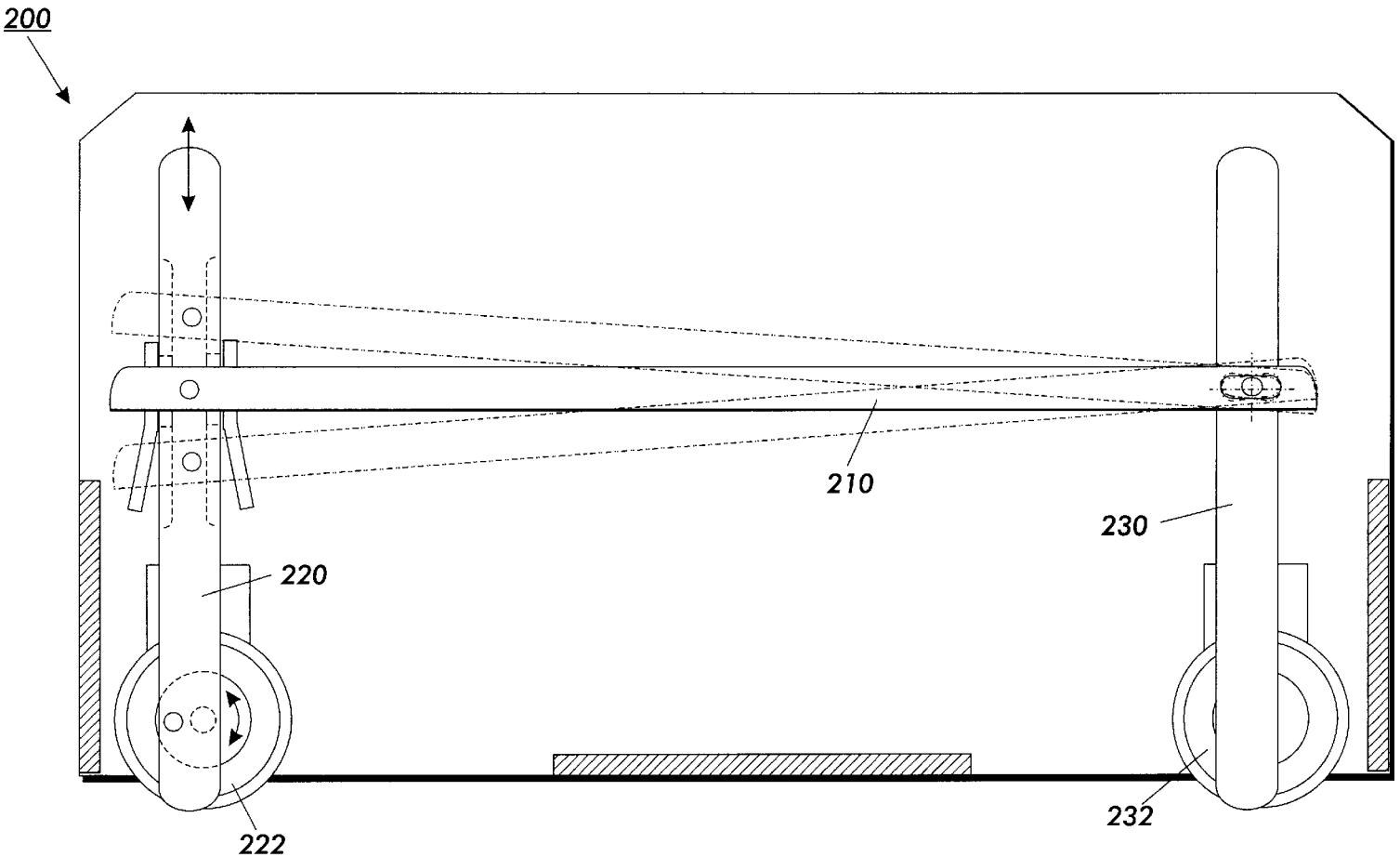
FIG. 3 is a detailed side view of the elevator drives for the feeder.

Turning to FIGS. 2 and 3, there is illustrated the general configuration of a multi-position stack height (contact) sensor (can detect 2 or more specific stack heights) in conjunction with a second sensor 340 near the stack lead edge which also senses distance to the top sheet (without sheet contact). The two sensors together enable the paper supply to position the stack 53 with respect to the acquisition surface 302 both vertically and angularly in the process direction. This height and attitude control greatly improves the capability of the feeder to cope with a wide range of paper basis weight, type, and curl.

Proper feeding with a top vacuum corrugation feeder (VCF) requires correct distance control of the top sheets in the stack 53 from the acquisition surface and fluffer jets 360. The acquisition surface 302 is the functional surface on the feed head 300 or vacuum plenum. In current feeders, the distance control is accomplished using only a stack height sensor. This concept proposes a multi-position stack height (contact) sensor 350 (can detect 2 or more specific stack heights) in conjunction with a second sensor 340 near the stack lead edge (LE) which also senses distance to the top sheet (without sheet contact). The two sensors together enable the paper supply to position the stack with respect to the acquisition surface both vertically and angularly. This height and attitude control greatly improves the capability of the feeder to cope with a wide range of paper basis weight, type, and curl. Both acquisition time and shingle feed prevention are improved.

Further improvement may be gained by the setting of positive and negative air pressures in the paper feeder based on specific paper/media characteristics. These characteristics could include: sheet basis weight, size, coating configuration, curl direction and magnitude. Since desired air pressures are a function of these paper characteristics, this will allow for real time compensation (for the variabilities expected in these media characteristics) instead of a "one pressure fits all" approach. By adjusting pressures in response to these paper characteristics, key feeder responses (sheet acquisition times, misfeed rates and multifeed rates) can be kept closer to their optimized target values.

The paper feeder design acquires individual sheets of paper (using positive and negative air pressures) from the top of a stack and transports them forward to the TAR. Among the independent variables in the paper feeder design are two sets of air pressures. Fluffer pressures, which supply air for sheet separation and vacuum pressure which cause sheets to be acquired by the shuttle feed head assembly. Each set of pressures is supplied from one combination blower. As fluffer pressure increases the sheets on the top of the stack become more separated with the top most sheets being lifted closer to the vacuum feed head. As the fluffing pressure gets higher, the risk of more than one sheet being moved into the take-away nip, when the feed head moves increases also, (a.k.a. multifeed). As the fluffing pressure gets lower, the risk of the top sheet not getting close enough to the feed head (and thus not becoming acquired by the vacuum present on the bottom of the feed head) increases which can result in no sheet being fed when the feed head moves forward,(a.k.a. misfeed or late acquisition). The optimum amounts of fluffer and vacuum feed-head pressures are a function of the size and weight of the sheets (larger, heavier sheets requiring more fluffing and vacuum and visa-versa for smaller, lighter sheets). This in combination with the amount and direction of curl in the paper which has an effect on the distance between the feed head and the sheets on the top of the stack as discussed above. As such, optimized stack height and LE gap settings may vary as a function of this curl. By using information input by the operator (paper weight and coating configuration) and information from sensors (indicating curl direction and magnitude), the respective blower speed can be adjusted to achieve the best possible performance for the given paper conditions.

This concept of varying air pressures in combination with the tray angling reduces the variability in key feeder performance characteristics such as "sheet acquisition times" and "sheet separation". As a result of this reduced variability, the feeder's performance (as measured by misfeeds, late feeds and multifeeds) is inherently better than designs not incorporating this concept. This concept also reduces the need for operator interventions (flipping, rotating and/or replacing paper) for feeder performance problems that are the direct result of differing paper properties (sizes, weights & coatings) and normal variations in sheet curl from ream to ream, or from paper to paper.

Proper stack orientation requires the stack 53 be tilted with the stack leading edge higher or lower than the stack trailing edge depending on whether there is down-curl or up-curl. This tilting brings the leading edge 152 of the top sheets of the stack 53 into proper location relative to the acquisition surface 302 of the feed head 300 and the fluffing jets. In order to institute the corrective tilting action, the height of the top sheet 52 near the leading edge 152 must be sensed, relative to the feed head 300, prior to acquisition and with the air system on and the stack "fluffed".

The process to set up the stack orientation to the feed head is:

1. Paper supply starts with the tray lead edge ramped up 1.4 degrees.
2. Paper is loaded.
3. Required paper properties are inputted or sensed automatically (eg., gsm, size, etc.).
4. Elevator raises to lowest possible stack height (To maintain stack control using tray guides in preparation for air system turning on).
5. Initial tray angle is removed based on paper gsm
6. Air system activates fluffer and air knife jets, but vacuum is valved to off position.
7. Stack Height arm is raised & Lead edge attitude sensor is interrogated for top sheet position relative to feed head acquisition surface (sensor may be position sensitive device type or multiple sensors with different focal lengths, etc.).
8. Based on positions sensed by stack height and lead edge attitude sensors, the tray angle and/or stack height is adjusted until the desired sensor states are achieved. The processes used to achieve these states are summarized in Table 1. In order to reach the desired sensor states, it may be necessary to execute more than one of the processes listed. Upon completion of adjustments to the tray angle, stack height is verified.
9. Feeding commences and stack height and lead edge attitude positions are checked each feed with corrections made accordingly. This enables compensation for stack shape (curl) changes throughout feeding of a typical 2500 sheet stack at maximum feed rates of up to 280 pages per minute (PPM).

As seen in FIGS. 3–6, the lead 152 and trail 153 edges of the tray 210 in the paper supply are independently controlled. By tilting the tray 210 at an incline/upcline severe upcurl/downcurl, respectively, can be compensated. In current designs, elevators are driven with one motor and cannot be used to compensate for curl. Tilting the tray in the manner illustrated significantly reduces the number of multi-feeds for light weight media, and decreases the acquisition time for heavy weight papers.

Turning to FIGS. 3–6, to compensate for curl in the stack, the elevator uses two independent motors 222, 232 to control the attitude of the tray 210. The attitude of the tray 210 is used to maintain a gap between the top of a fluffed stack 53 of paper and the lead edge of the feed head 300. The gap is maintained by adjusting the attitude of the tray 210, based on sensor feedback as described above.

Figure 5:
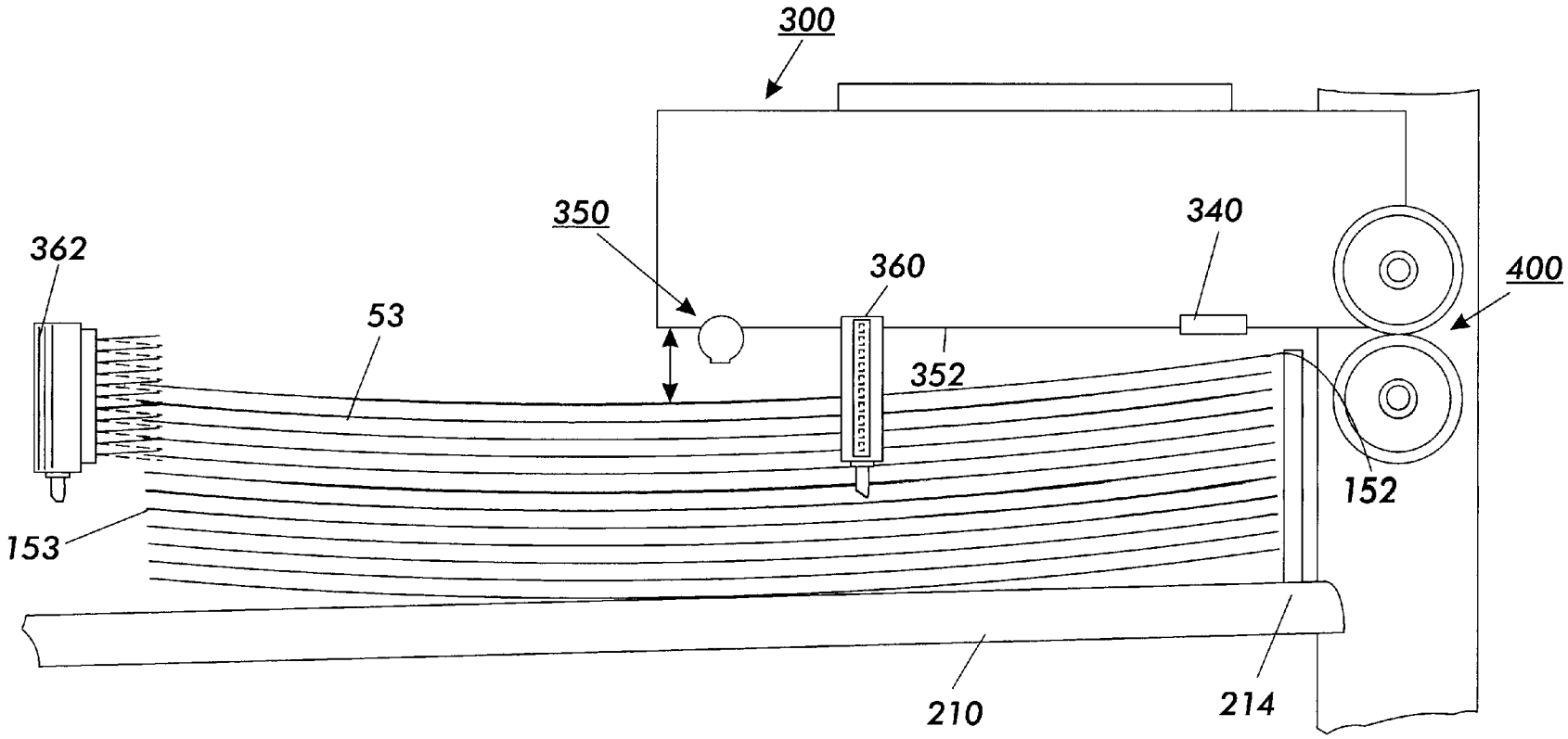
FIG. 5 is a is a detailed side view of the sheet stack illustrating a downcurled sheet situation.

The tray 210 is initially tilted up on the lead edge 152 (LE) side, approximately 1.40 when paper is loaded. The initial angle is set at the maximum allowable angle while still maintaining stack capacity. If the paper was loaded in a flat tray and the tray 210 had to compensate for downcurl, the LE would be tilted up (FIG. 5). By tilting up after the paper is loaded, the LE 152 of the stack 53 will be pulled away from the LE registration wall 214. Therefore, it is necessary to have an initial degree of tilt in the tray 210. By using a combination of sensors in the feedhead to detect proximity of the sheet stack, which can reflect the curl, the elevator is sent a signal to compensate for curl. Depending on the state of curl the elevator will tilt up/down for downcurl/upcurl, respectively. Tilting up to compensate for down curl will be limited to a maximum to prevent a large gap between the LE 152 of the paper and the LE registration wall 214.

Figure 4:
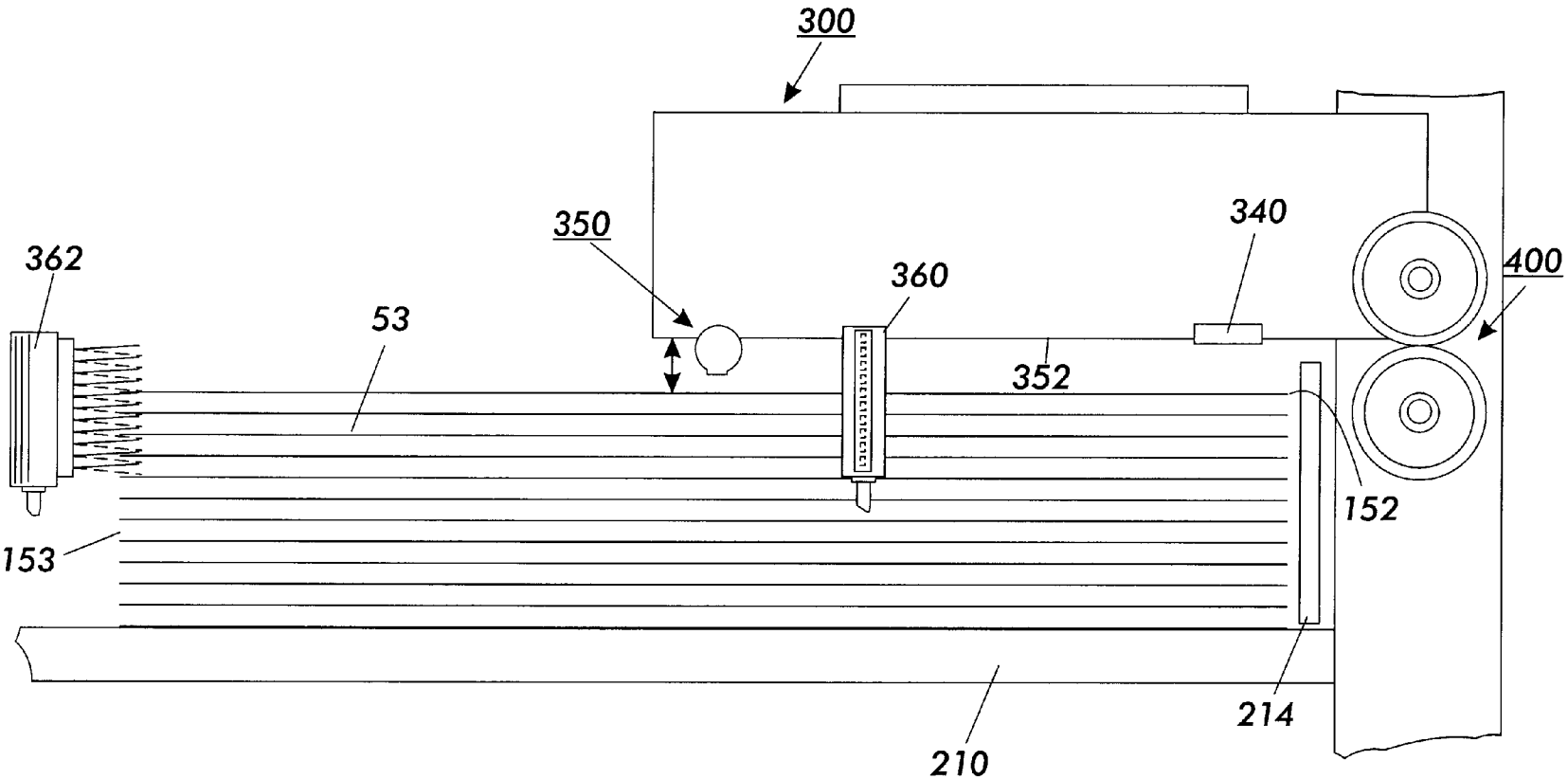
FIG. 4 is a detailed side view of the sheet stack illustrating the fluffer and feedhead positions.
Figure 6:
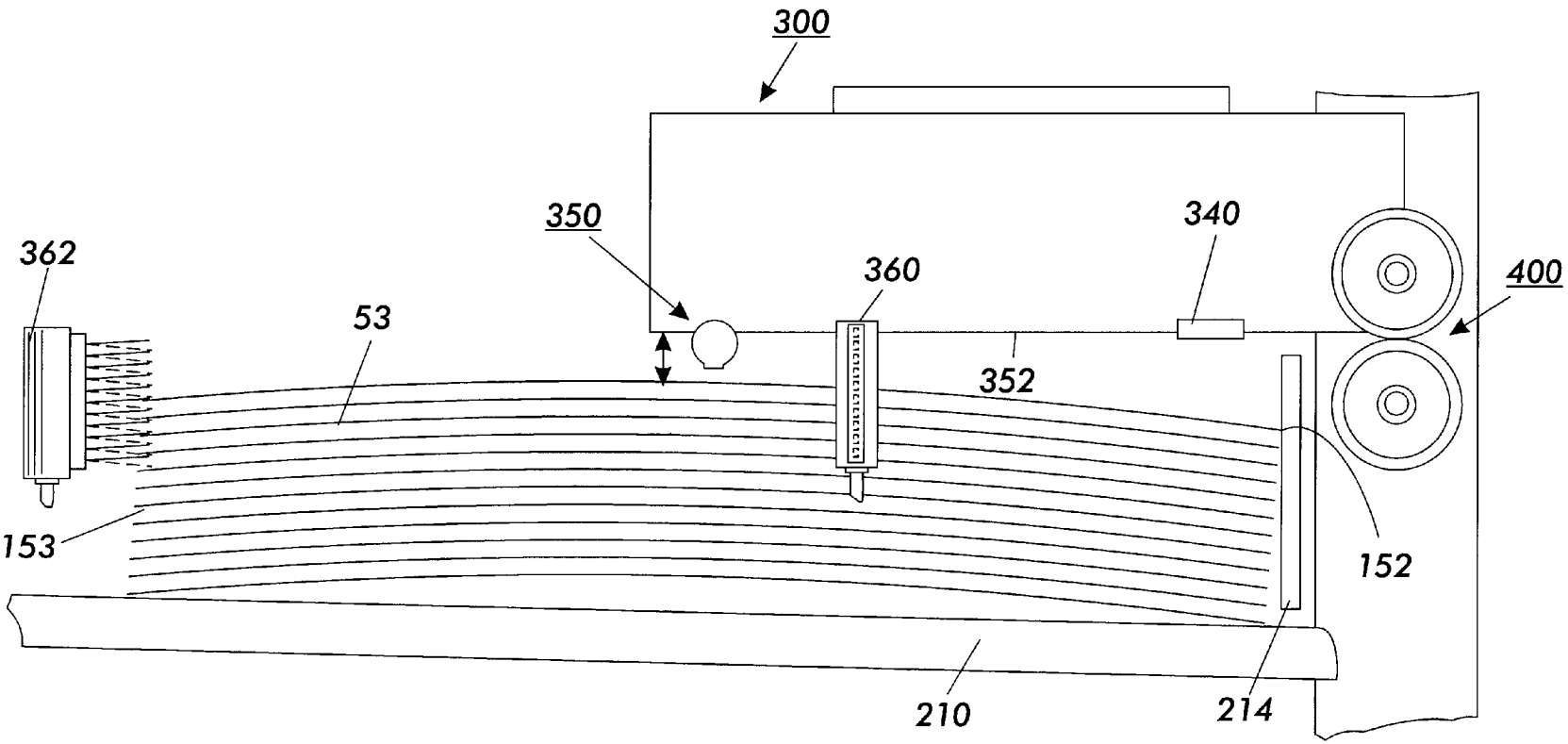
FIG. 6 is a is a detailed side view of the sheet stack illustrating an upcurled sheet stack situation.
Figure 7:
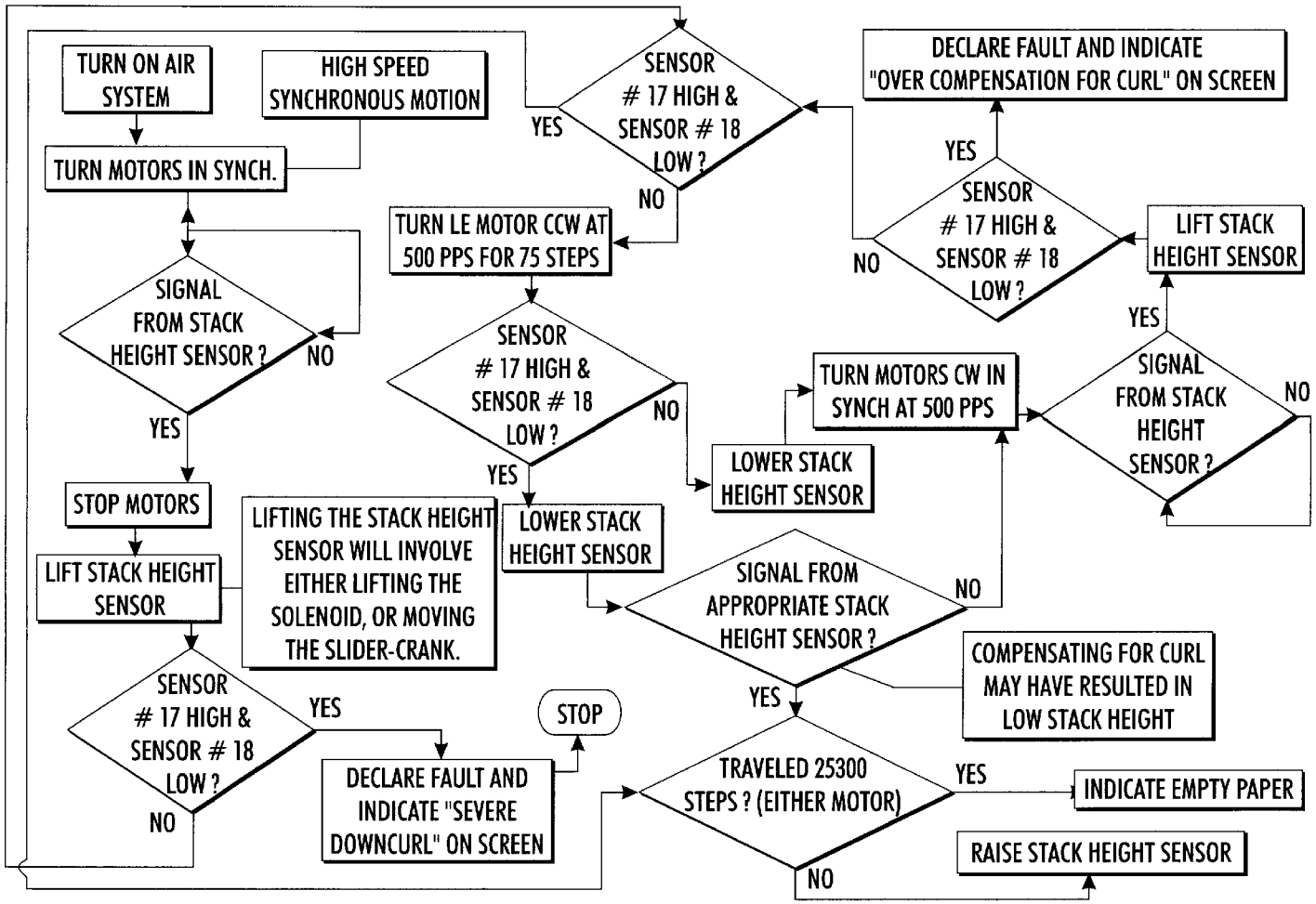
FIG. 7 is a flow diagram of the sheet stack adjusting sequence.
Figure 8:
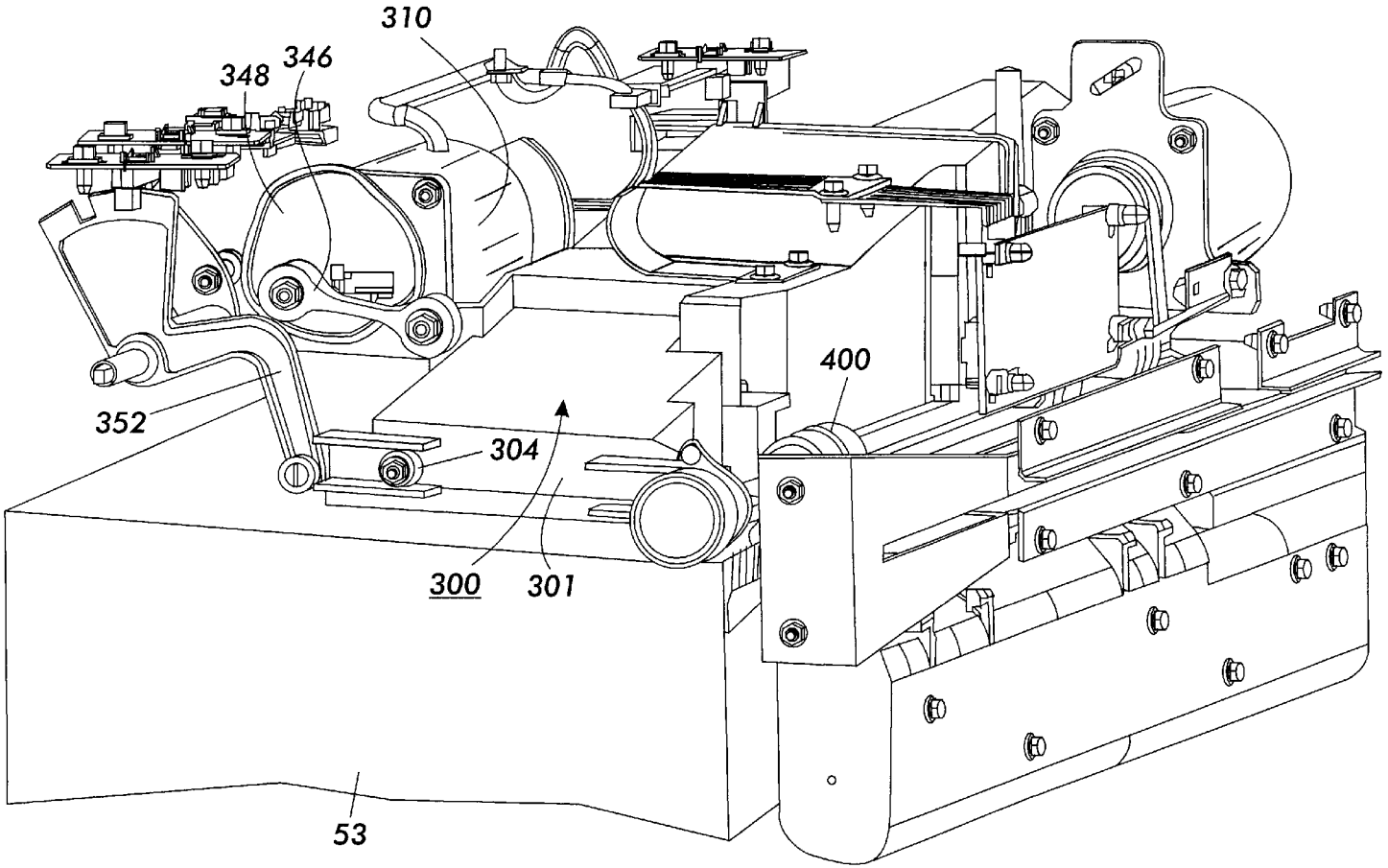
FIG. 8 is a perspective view of the shuttle feedhead and dual flag stack height sensor.
Figure 9:
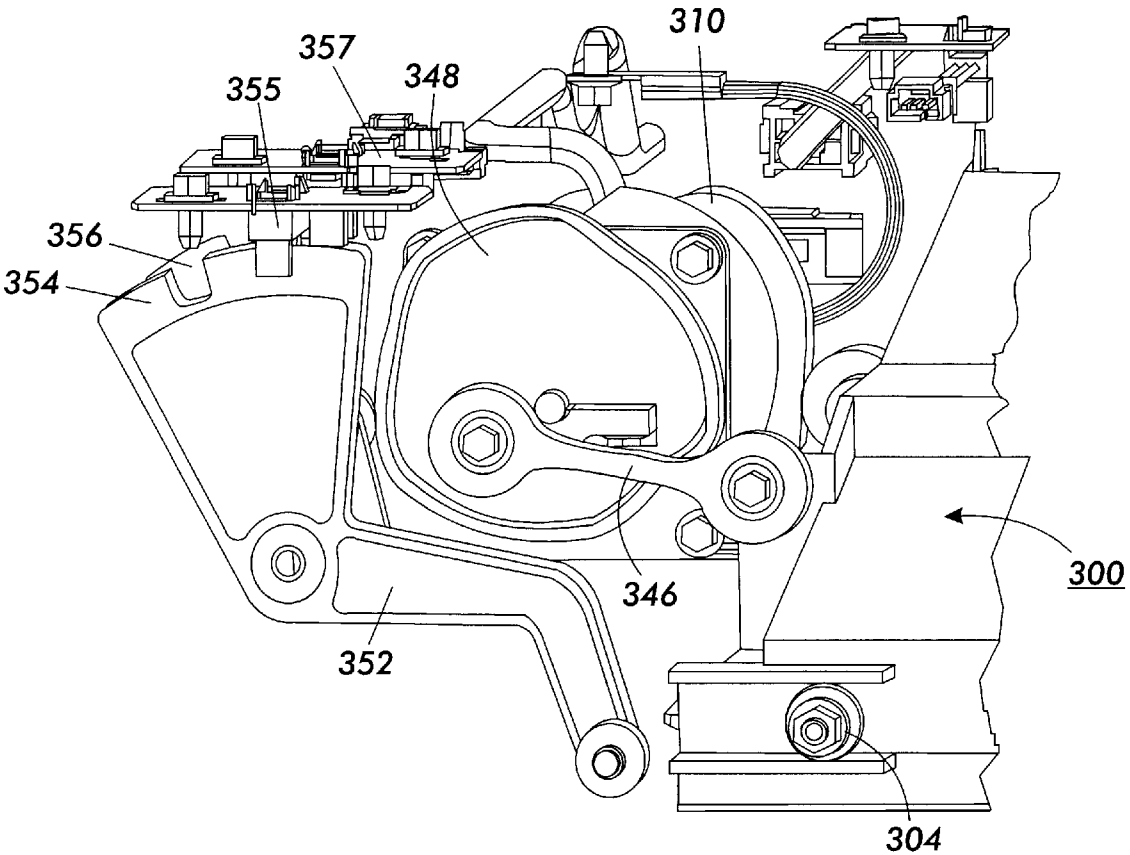
FIG. 9 is a detailed perspective of the actuator for the dual flag stack height sensor.

After the paper 53 is loaded, the tray 210 will raise to stack height. Following this a sequence of events take place to determine the initial amount of compensation necessary for the stack. This routine is unique from the dynamic curl compensation that occurs during feeding. The initial determination of the angle for the tray is shown in FIGS. 4–6. During the feeding cycle, the attitude of the tray 210 will adjust automatically to compensate for curl. This will optimize feeding continuously, throughout a cycle. This will help to minimize misfeeds and acquisition time.

Paper characteristics such as dimensions (process and cross-process), and weight (gsm) will be loaded into the print station controller by the operator or determined automatically by sensors in the machine. The previously mentioned characteristics are utilized by the feeder module to tailor the module's control factor settings to the paper being run. To compensate for variation in paper characteristics, the paper tray 210 in the feeder module uses two independent motors 222, 232 to position the lead edge 152 of a stack 53 within a prescribed range based on feedback from stack height 350 and lead edge attitude sensors 340. Stack height is defined as the distance from the top of the stack to the acquisition surface 302. The lead edge attitude sensor 340 measures the distance from the top of the stack 53, at the lead edge 152, to the acquisition surface 302 (referred to as range). The range in which the stack lead edge 152 is positioned is determined by weight, based on the failure modes typically associated with the paper. For example, heavy weight papers are typically more difficult to acquire than lightweight papers, therefore, the range for heavy weight papers is closer to the feedhead 300 than the lightweight range. Lightweight papers, which typically are more prone to multifeed, are set up in a range which is further from the feedhead, thus preventing sheets from being dragged into the take away roll by sheet to sheet friction. This angling, tray enables the feeder module to achieve these desired ranges even when the paper is curled in the process direction. This invention proposal describes the algorithm used to control the tray motors in order to provide a quick and reliable setup.

The angle of the paper supply tray is set up using two sensors, the stack height sensor and the lead edge attitude sensor. Each of these sensors measures the location of the top of the paper stack. In the preferred embodiment, the stack height sensor is actually a pair of transmissive sensors and preferably indicate a 10, 12.5, 15, >15 mm stack height. The lead edge attitude sensor is an infrared LED with 4 detectors which is used to determine the location of the stack lead edge within a range of 0–3, 3–6, 6–9 or >9 mm from the feedhead. In the current application, the 0–3 mm range is used to measure sheet acquisition time. This is accomplished by measuring the time from vacuum valve "open" signal until the 0–3 range is detected, indicating sheet acquisition. The desired stack height and lead edge position are determined by user input of the paper weight in gsm. The combinations of these sensors will indicate when the stack is in any of the following conditions:

TABLE 1

| Stack Height: | Lead Edge Range: | Control Algorithm Response: |
|---|---|---|
| Too Low | Too Low | Raise tray maintaining current angle until either desired Stack Height or desired Lead Edge position are reached |
| Too Low | Correct | Raise tray only at Trail Edge until Stack Height is reached |
| Too Low | Too High | Raise tray only at Trail Edge until Stack Height is reached |
| Correct | Too Low | Pivot tray counter clockwise around Stack Height measurement location until desired Lead Edge position is reached. |
| Correct | Correct | No response required |
| Correct | Too High | Pivot tray clockwise around Stack Height measurement location until desired Lead Edge position is reached. |

The process illustrated in the table above is as follows:

Loading: When tray empty is reached, the tray lowers and is leveled when it reaches the lower limit sensors (not shown) for the lead and trail edge of the tray 210. At this point the lead edge of the tray is raised to approximately 1.4 degrees before the latch is released for paper loading.

Initial Angle & Lift: Once the operator loads the tray, the tray raises until the transition which indicates the lowest stack position at the stack height sensor or the lead edge attitude sensor occurs. At this point, the air system is turned on so that a measurement of the lead edge position of the fluffed stack can be taken.

The possible conditions once the air system is turned on & lead edge measurement is taken are as follows:

A) Stack Height is Correct—Lead Edge is Correct: In this condition no further set up of the tray is required. Wait for feed signal.

B) Stack Height is Correct—Lead Edge is Too Low: Tray will rotate counter clockwise about stack height measurement point until the lead edge is in the correct state. This is achieved by driving the stepper motors at lead and trail edge in opposite directions at a speed ratio defined by the distance of the lift points from the stack height measurement point. Note this condition could result in misregistration of stack lead edge (See "loading" under fault prevention section below).

C) Stack Height is Correct—Lead Edge is Too High: Tray will rotate clockwise about stack height measurement point until the lead edge is in the correct state. This is achieved by driving the stepper motors at lead and trail edge in opposite directions at a speed ratio defined by the distance of the lift points from the stack height measurement point.

D) Stack Height is Too Low—Lead Edge is Correct or Too High: Raise trail edge only until stack height is achieved. Measure location of lead edge and execute A), B), or C) as required.

E) Stack Height is Too Low—Lead Edge is Too Low: Raise tray, maintaining current angle until correct stack height or lead edge state is reached. Measure location of lead edge and execute A), B), or C) as required.

NOTE: Since the tray is initially raised only until the lowest lead edge state or stack height is reached, a condition in which the stack height reached is too high should only occur as a result of a stack height sensor failure or a customer loading the tray above the maximum fill line.

There are also various Fault Prevention Measures which are incorporated into the system:

Loading: The reason for the initial "loading angle" is to minimize conditions in which the lead edge of the stack would be too low during tray setup. If stack height has already been achieved, this lead edge low condition results in the tray being rotated counter clockwise and could result in the top of the stack moving away from the registration edge at the lead edge of the paper supply. By loading the tray with the lead edge up the tray will, in most cases, rotate such that the stack lead edge will be driven into the lead edge registration wall.

Initial Angle & Lift: Because the stack is fluffed during setup, it is important to avoid lifting the lead edge of the stack above the top of the lead edge registration wall. If the sheet floats over the top of the wall it could result in an incorrect setting of the position of the stack lead edge and skewed sheet feeding. The lead edge sensor may detect that lead edge is too close to the feedhead and as a result, drop lead edge. Since the lead edge is resting on the reg. wall, it will not drop away and the tray will rotate to its limit. In order to prevent this from occurring, before the air system is turned on, the angle in the tray is reduced depending on the weight of the paper (high, medium, or low), in the tray. The degree to which the tray angle is leveled was determined based on the final angle typically reached after tray set up was completed. For example, because the lead edge of lightweight paper typically fluffs higher than heavier weights, and this results in the tray angle being 0 degrees or less (negative angle indicating lead edge is lower than trail edge) after loading, the tray levels before the air system turns on and the set up process begins The set up process incorporates routines to prevent or detect faults such as excessive angling of the tray, tray over travel or failures to move the tray.

During each feed, when the trail edge 153 of the sheet being fed passes the stack height arm 352, the arm compresses the stack 53, the stack height sensors measure the position of the solid stack, and the stack height arm 352 is raised again. Once the trail edge 153 of the sheet 52 passes the position of the lead edge attitude sensor 340, the position of the lead edge 152 of the fluffed stack 53 is measured. The values of these measurements are then compared to the desired states for the paper being fed and the tray is adjusted accordingly. Regardless of the state of the stack lead edge, when the stack height sensor indicates the stack is too low, the tray increments approximately 1 mm. The frequency of angular adjustment based on feedback from the lead edge attitude sensor 340 is based on the mode of the last few sheets recorded. For example, the lead edge gap measurement is recorded for 3 feeds, if the mode indicates the stack lead edge was not in the correct range most frequently, the tray angle is adjusted accordingly. The mode is used to avoid over compensation for individual sheets within the stack. For example, if a single sheet was not properly registered and has some edge damage or curl at the lead edge, we would not want to immediately shift the entire stack. Of course depending on the situation, more or less samples can be used to perform the dynamic adjustment.

Once the setup process is completed, the system then feeds sheets to the printer and compensates for variations in the stack as described above. The feedhead 300 is a top vacuum corrugation feeder (TVCF) shuttle which incorporates an injection molded plenum/feed head 301 with a sheet acquisition and corrugation surface 302. The feed head 300 is optimally supported at each corner by a ball bearing or other low friction roller 304. In the preferred embodiment, the feed head 300 is driven forward 20 mm and returned 20 mm back to home position by a continuous rotation and direction twin slider-crank drive 346 mounted on a double shaft stepper motor 310. This includes 5 mm overtravel to account for paper loading tolerance and misregistration. This drive results in a linear sheet speed of only about 430 mm/s as the sheet is handed off to the take away roll 400 (TAR). The TAR 400 is also stepper driven and accelerates the sheet up to transport speed. Since the stepper controls are variable in software, the feeder can feed from any minimum speed to a demonstrated PPM rate of 280 (for 8.5") for a wide range of paper type, basis weight, and size with no hardware changes.

The stack height sensor 350 is mounted on the outboard side of the feed head 300 about 6 inches back from stack lead edge. The purpose of this is to keep the stack height sensing near the fluffer jets 360 which are also mounted on the inboard and outboard sides of the stack about 5 inches back from stack lead edge 152. These measurements, while used in the preferred embodiment are not critical, except that it is desirable to have the sensor arm and the fluffer jets 360 in relatively close proximity. This insures that the top of the sheet stack will be well controlled with respect to the fluffer jets. During the sheet feed out process, after the feed head 300 hands off the sheet to the TAR 400, the feed head 300 delays in the forward position to allow the sheet to feed to the point where the trail edge 153 (TE) just passes the stack height sensing position. When the TE of the sheet reaches this point, the delay has already ended and the feed head 300 has returned to a point where a concentric (to feed head drive) cam 348 will drop the spring loaded stack height sensing arm 352 onto the stack 53. This arm 352 rests on the stack for about 25 ms and software monitors the stack height zone. Then, as the feed head drive 346 continues, the cam 348 lifts the arm 352 from the stack 53 as the feed head 300 reaches its "home" position. The stack height sensor actually consists of two low cost transmissive 355, 357 sensors used in parallel with two flags 354, 356 mounted on the stack height sensing arm 352. This provides four stack height zones: >15 mm, 15–12.5 mm, 12.5–10, mm and <10 mm as indicated in Table 2 below and shown in FIGS. 10 and 11. Testing has indicated that with lighter weight papers, a further distance between top of stack and acquisition surface 302 is desirable to prevent compression of sheets against the feed head from the side fluffers 360. With intermediate and heavier basis weight papers, a closer zone (12.5 or 10 mm) is desirable to minimize sheet acquisition times.

TABLE 2

| Sensor State | | Stack |
|---|---|---|
| Sensor 1 | Sensor 2 | Height |
| 1 | 1 | >15 mm |
| 1 | 0 | 15 mm |
| 0 | 0 | 12.5 mm |
| 0 | 1 | 10 mm |

Some of the benefits of the illustrated feedhead design are:

Reliable stepper motor driven feed head with twin drive points to minimize skew.

Can customize feed head acceleration profile with delay to enable stack height measurement as part of motor drive.

No belt coast problems due to inertia resulting in shingle multifeed risk and need for drag brake.

Consistent acquisition hole pattern position relative to stack LE to avoid vacuum leakage in front of LE.

Short feed head stroke before sheet is under control of TAR 400 assembly.

Feed head supports sheet fully as it carries it to the TAR 400. Avoids "pushing on rope" scenario with earlier systems which drive the sheet greater than 90 mm to the TAR.

As previously mentioned, light and heavy weight media typically have two different failure modes. Lightweight media is generally easily acquired but difficult to separate, resulting in a increased tendency to multifeed as compared to heavyweight media. On the other hand, although heavyweight media is less likely to multifeed, it can at times be difficult to acquire. Using an analog stack height sensor, or multiple digital sensors, the stack height of the feeder module can be adjusted to compensate for the basis weight of the media being fed. This "optimization" of the stack height to address the media's failure mode results in increased latitude.

Figure 10:
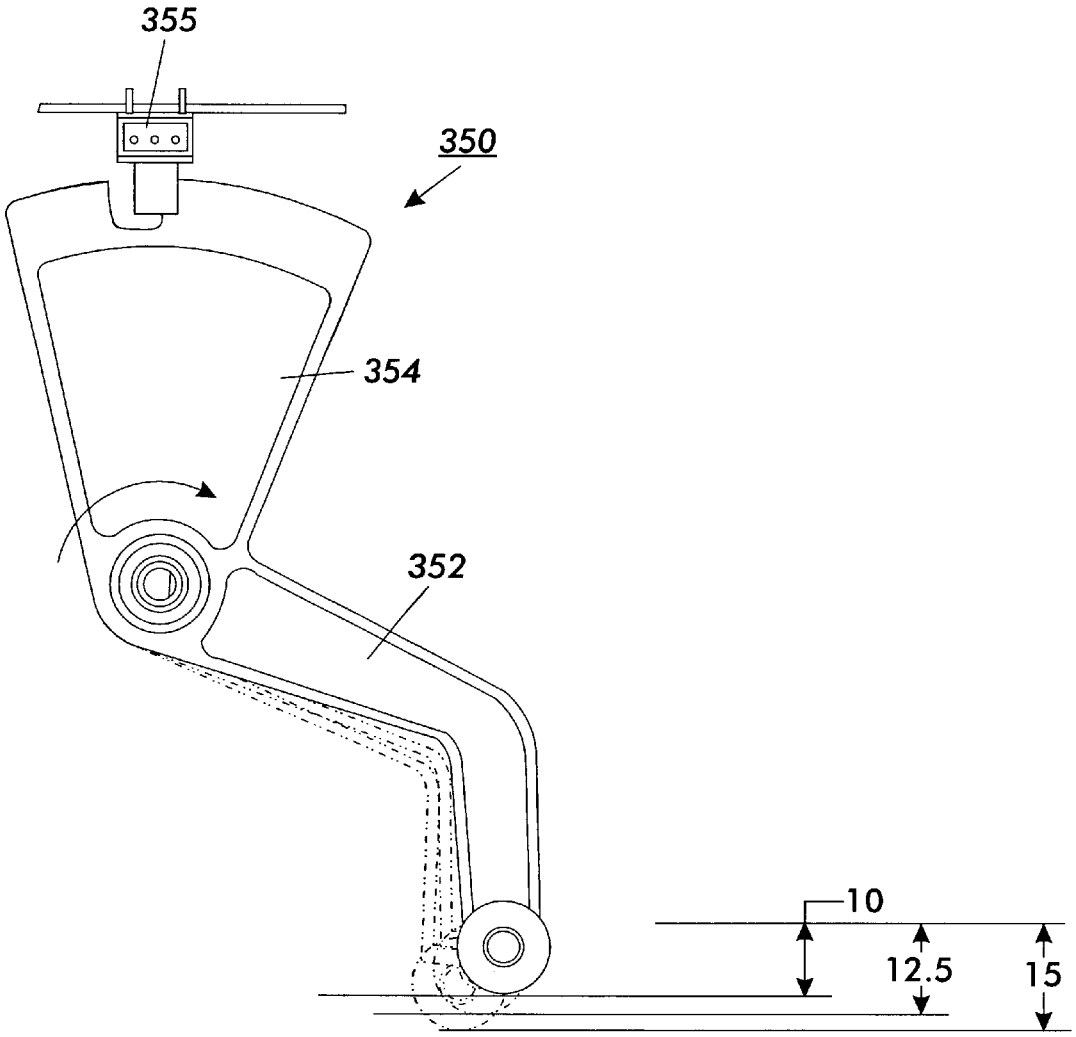
FIG. 10 is a side view illustrating the ranges of the dual flag stack height sensor.
Figure 11:
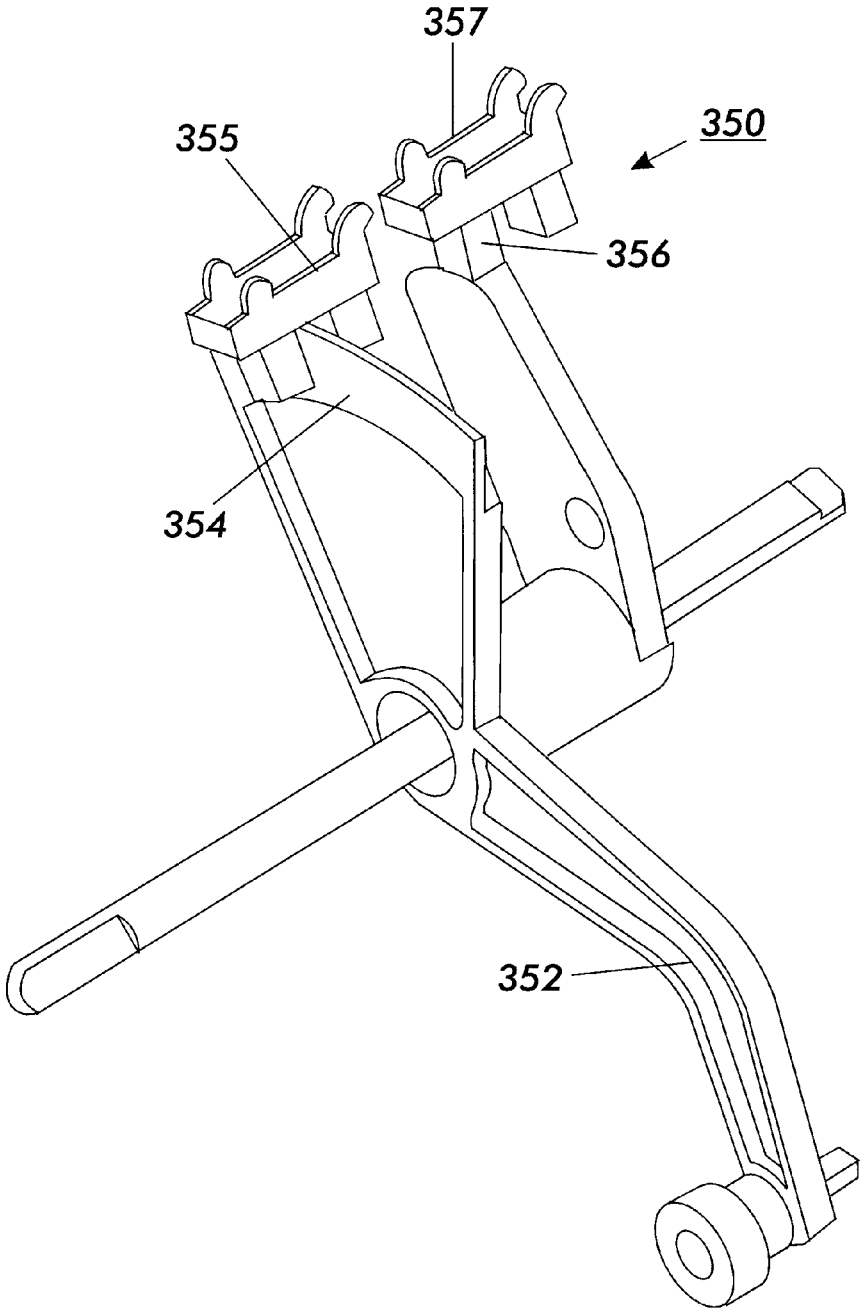
FIG. 11 is a perspective detail of the dual flag stack height sensor arm and sensing members.

Using a stack height assembly consisting of two transmissive sensors 355, 357 and two flags 354, 356, the stack height of a feeder module can be set to three different levels depending on the weight of the media. This "optimization" of the stack height to address the media's failure mode results in increased latitude. When feeding lightweight media, the stack height is set larger in order to increase the gap to the feedhead 300. This allows more room for separation of the media using fluffer jets 360. This increased gap also reduces the chances that the unacquired media will be fluffed into contact with the acquisition surface 302 and subsequently be shingle fed into the take away roll 400 due to the friction between sheets. When feeding heavyweight media the stack height will be set smaller. This reduces the gap to the feedhead and reduces the time required to acquire. FIGS. 10 and 11 depict the three stack height zones and the stack height assembly which will be used in the feeder module 200. By adjusting the positions of the sensors and/or the configuration on the flags, the transition points could be adjusted to different levels. In the illustrated design, the stack height transitions occur at 15, 12.5, and 10 mm. The sensor states that indicate these levels are shown in Table 2.

Some of the benefits of the illustrated stack height sensing design are:

Moved close to fluffer jets to better control relationship of where fluffing flow is applied and where the top of the paper stack actually is.

Low cost because no additional components required to apply stack height arm to stack intermittently (driven from feed head drive motor).

Adds no drag force on paper during drive out to contribute to skew or marking.

Three settable stack heights with two sensors provide more appropriate stack height setting for wide paper specification range.

Enables "service mode" position to avoid damage during paper supply open/close operation.

Another problem faced by previous feeders is that they must be able to feed a wide variety of paper sizes and basis weights (i.e. 60–270 gsm, 5.5×7" short edge feed(SEF) to 14.33×20.5" SEF) which results in a significant range of sheet mass (1.5–51.2 gm). This sheet mass must be accelerated by a take away roll (TAR) nip 400 up to the steady state transport speed of the printer, typically within about 35–40 ms in the case of a high speed printer. This acceleration can be accomplished using a stepper motor, but a problem encountered with this type of system is the torque and drive roll friction required to accelerate the high sheet mass papers to the maximum transport speed.

Sheet mass is partially a function of the paper length in the process direction. In a printer that has discrete pitch length zones, the pitch rate changes with the sheet length. For example, a 4 pitch mode may have a pitch time of 1480 ms while a 12 pitch mode will have a pitch time of only 493 ms. These pitch times may get as short as only 211 ms pitch time for a (240 PPM) 13 pitch mode.

The feed process is made up of basically two components: 1) sheet acquisition including multiple sheet separation time, and, 2) sheet drive out time. As the pitch time increases, required acquisition and separation time do not increase at the same rate. For example, there are differences in the acquisition times between a 2 gm and 50 gm sheet, which are on the order of 40 ms for the 2 gm sheet and 120 ms for a 50 gm sheet. From the pitch times quoted above, there could easily be almost 1000 ms more due to longer pitch times compared to an acquisition separation time increase of only about 80 ms for the same sheet size range.

Since it is known from either customer provided input or automatic sensing what sheet length and resulting pitch size are feeding from any tray, the acceleration profile for the TAR can be customized according to how much time is available to bring the sheet to transport speed in a given pitch zone. For longer sheet length with higher mass, there is also more acceleration time available and can reduce the required acceleration to a value that the motor and drive nip friction can handle thereby keeping motor size down and making more efficient use of the available torque of the motor with no added cost.

The motor acceleration for the TAR 400 is controlled by an exponential equation which has an acceleration constant multiplying factor. Optimum acceleration constants for the extreme cases of pitch size were determined empirically using the heaviest weight and the shortest and longest pitch lengths. For all pitch lengths in between the extremes, a linear extrapolation was used to determine each constant value.

Thus, what has been disclosed is a sheet feed apparatus having a vacuum source, the vacuum source being selectively actuable to acquire and release a top sheet from a stack; a feedhead, attached to the vacuum source to acquire the top sheet of the stack; and a unidirectional drive mechanism, the drive mechanism being driven in a single direction while causing the feedhead to reciprocate from a first position to a second position. Additionally, the sheet feed apparatus can include a stack height sensor actuator coupled to the unidirectional drive mechanism and a stack height sensor attached to the stack height sensor actuator so that the stack height sensor contacts and disengages the sheet stack at a preselected time coordinated with the reciprocating motion of the feedhead. Moreover, the stack height sensor actuator can comprise a cam member, attached to the unidirectional drive mechanism and rotating therewith; a biasing member; a cam follower, attached to the biasing member and biased into contact with said cam and attached to said stack height sensor to control the movement of said stack height sensor. Furthermore, the sheet feed apparatus can include a unidirectional drive mechanism which comprises a stepper motor operating in a unidirectional rotational mode.

In recapitulation, there is provided a feed apparatus which combines a slider crank feed head drive system and cam actuated stack height sensing system to form a new combined shuttle feeder. The new feed head drive includes the replacement of a solenoid driven feed head with a more reliable stepper driven twin slider crank drive. Included in the slider crank drive for the feed head is an integral cam as part of the crank arm mounted to the motor shaft. This cam is designed drives a stack height sensor to drop and lift the stack height sensing arm to sense stack height after the sheet trail edge has passed the point of arm contact with the stack. The cam also provides a "service mode" position for the stack height arm which lifts it out of the way of the paper supply when it is opening. The cam dwells in a neutral home position during the rest of the drive out and return motion of the feed head It is, therefore, apparent that there has been provided in accordance with the present invention, a sheet feeding apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet feeding apparatus, comprising:

a take-away nip;

a pneumatic sheet feeder being selectively actuable to acquire a sheet from a stack and transport the sheet towards the take-away nip, the sheet feeder having a feedhead, the feedhead having an acquisition surface, the acquisition surface being substantially aligned with the take-away nip, the feedhead being moveable from a first position at which the sheet is acquired from the stack to a second position at which the sheet is handed off to the take-away nip, wherein the acquisition surface remains substantially aligned with the take-away nip as the feadhead acquires the sheet from the stack and hands the sheet off to the take-away nip; and a drive mechanism operating to reciprocate the feed head between the first and second positions.

2. A sheet feeding apparatus according to claim 1, further comprising a stack height sensor, the stack height sensor being coupled to the drive mechanism to move the stack height sensor between a sensing position in contact with the stack and a home position disengaged from the stack at a preselected time coordinated with the reciprocating motion of the feedhead.

3. A sheet feeding apparatus according to claim 2, wherein the stack height sensor is a multiple position stack height sensor capable of detecting at least three stack height zones.

4. A sheet feeding apparatus according to claim 2, wherein the feedhead receives a negative air pressure, a magnitude of the negative air pressure being varied in response to a sheet parameter.

5. A sheet feeding apparatus according to claim 2, further comprising:

a cam member coupled to the drive mechanism; and a slider-crank drive coupled between the cam member and the feed head.

6. A sheet feeding apparatus according to claim 5, further comprising:

a cam follower attached to stack height sensor and biased into contact with the cam member.

7. A sheet feeding apparatus according to claim 6, wherein the drive mechanism is a motor operating in a unidirectional mode for rotating the cam in a single direction.

8. A sheet feeding apparatus according to claim 1, further comprising a stack height sensor, the stack height sensor having a stack height sensing arm, the stack height sensor being coupled to the drive mechanism to drop the stack height sensing arm onto the stack and to lift the stack height sensing arm from the stack.

9. A sheet feeding apparatus according to claim 8, wherein the stack height sensor further comprises a plurality of sensor flags mounted on the sensing arm for detecting at least three stack height zones.

10. A sheet feeding apparatus according to claim 8, wherein the stack height sensing arm is dropped onto the stack after a trail edge of the sheet passes the stack height sensor.

11. A sheet feeding apparatus according to claim 1, further comprising:

a source of sheet parameter information; and a variable drive source coupled to the take-away nip and varying one of the speed and acceleration of said take-away nip dependent upon the sheet parameter information.

12. A sheet feeding apparatus according to claim 1, wherein the feedhead remains in substantially the same plane as the feedhead reciprocates between the first and second positions.

13. A sheet feeding apparatus according to claim 1, wherein the feedhead remains in substantially the same plane as the feedhead reciprocates between the first and second positions, the plane being substantially parallel to the acquisition surface.

14. A sheet feeding system, comprising:

a stack support for supporting a stack of sheets;

a take-away nip;

a pneumatic feedhead, the feedhead being coupled to receive a negative pressure from a vacuum source, the pneumatic feedhead being selectively actuable to acquire a sheet from the stack on the support and transport the sheet towards the take-away nip, the feedhead having an acquisition surface, the acquisition surface being substantially aligned with the take-away nip, the feedhead being moveable from a first position at which the sheet is acquired from the stack to a second position at which the sheet is handed off to the take-away nip, wherein the acquisition surface remains substantially aligned with the take-away nip as the feedhead acquires the sheet from the stack and hands the sheet off to the take-away nip; and a drive mechanism operating to reciprocate the feedhead between the first and second positions.

15. A sheet feeding system according to claim 14, further comprising a stack height sensor, the stack height sensor being coupled to the drive mechanism to move the stack height sensor between a sensing position in contact with the stack and a home position disengaged from the stack at a preselected time coordinated with the removal of a sheet from the stack.

16. A sheet feeding system according to claim 15, wherein the stack height sensor is a multiple position stack height sensor capable of detecting at least three stack height zones.

17. A sheet feeding system according to claim 15, further comprising:

a cam member coupled to the drive mechanism;

a cam follower attached to stack height sensor and biased into contact with the cam member; and a slider-crank drive coupled between the cam member and the feedhead.

18. A sheet feeding system according to claim 17, wherein the drive mechanism is a motor operating in a unidirectional mode for rotating the cam in a single direction.

19. A sheet feeding system according to claim 15, wherein the stack height sensor is dropped onto the stack after a trail edge of the sheet passes the stack height sensor.

20. A sheet feeding system according to claim 15, wherein the stack support is repositioned to adjust a stack height in response to a stack position determined by the stack height sensor and information identifying a predetermined property of the sheets.

21. A sheet feeding system according to claim 14, wherein a magnitude of the negative air pressure is varied in response to a sheet parameter.

22. A sheet feeding system according to claim 14, further comprising:

a source of sheet parameter information; and a variable drive source coupled to the take-away nip and varying one of the speed and acceleration of said take-away nip dependent upon the sheet parameter information.

23. A sheet feeding apparatus, comprising:

a take-away nip;

a pneumatic feedhead, the pneumatic feedhead being selectively actuable to acquire a sheet from a stack and transport the sheet towards the take-away nip, the feedhead being moveable between at least a first position at which the sheet is acquired from the stack and a second position at which the sheet is handed off to the take-away nip, the feedhead having an acquisition surface, the acquisition surface remaining substantially aligned with the take-away nip as the feedhead moves from the first position to the second position;

a drive mechanism coupled to the feedhead, the drive mechanism operating to reciprocate the feed head between the first and second positions when the drive mechanism is driven in a single direction; and stack height sensor movable between a sensing position in contact with a top sheet of the stack and a home position disengaged from the top sheet of the stack, the stack height sensor being coupled to the drive mechanism to move the stack height sensor between the sensing position and the home position at a preselected time coordinated with the movement of the feedhead.

24. A sheet feeding apparatus according to claim 23, wherein the stack height sensor is a multiple position stack height sensor capable of detecting at least three stack height zones.

25. A sheet feeding apparatus according to claim 23, wherein the drive mechanism includes:

a motor;

a cam member coupled to the motor; and a slider-crank drive coupled between the cam member and the feed head.

26. A sheet feeding apparatus according to claim 25, further comprising:

a cam follower attached to stack height sensor and biased into contact with the cam member.

27. A sheet feeding apparatus according to claim 25, wherein the motor operates in a unidirectional mode for rotating the cam in a single direction.

* * * * *